US006672694B2

(12) United States Patent
Shimizu

(10) Patent No.: US 6,672,694 B2
(45) Date of Patent: Jan. 6, 2004

(54) METHOD OF FORMING AN IMAGE ON OPTICAL DISKS BY INKJET PRINTING

(75) Inventor: Kano Shimizu, Tokyo (JP)

(73) Assignee: Nippon Bunkaseiko Co., Ltd., Tokyo (JP)

( * ) Notice: Subject to any disclaimer, the term of this patent is extended or adjusted under 35 U.S.C. 154(b) by 0 days.

(21) Appl. No.: 10/253,606

(22) Filed: Sep. 25, 2002

(65) Prior Publication Data

US 2003/0067499 A1 Apr. 10, 2003

(30) Foreign Application Priority Data

Oct. 10, 2001 (JP) ..... 2001-312568

(51) Int. Cl.[7] ..... B41J 3/00
(52) U.S. Cl. ..... 347/2
(58) Field of Search ..... 347/2, 11, 14, 347/19, 12, 10, 5, 8, 71, 40, 41, 51; 101/481, 486, 38.1; 400/118.2; 235/454; 380/30, 4, 3, 21, 28

(56) References Cited

U.S. PATENT DOCUMENTS 5,335,594 A * 8/1994 Karlyn et al. ..... 101/35
6,052,465 A * 4/2000 Gotoh et al. ..... 380/4

* cited by examiner

*Primary Examiner*—Raquel Yvette Gordon
*Assistant Examiner*—Charles W. Stewart, Jr.
(74) *Attorney, Agent, or Firm*—Leydig, Voit & Mayer, Ltd.

(57) ABSTRACT

This invention concerns a method of forming an image on optical disks by printing a white ground on an optical disk and drawing, using an inkjet printer, on optical disks arranged in a line. The printer head of the inkjet printer is scanned in the linear arrangement direction and all of the linearly arranged optical disks are contained within in a scanning range of the head of the inkjet printer so the printer head scans the optical disks in a single scan.

11 Claims, 1 Drawing Sheet

METHOD OF FORMING AN IMAGE ON OPTICAL DISKS BY INKJET PRINTING

BACKGROUND OF THE INVENTION

1. Field of the Invention

The present invention concerns an imaging method on optical disks by inkjet appropriate for label printing of optical disks such as CD, CD-ROM, VCD, CD-R, CD-RW, DVD, DVD-R, DVD-RW, DVD-RAM, DVR or others.

2. Description of the Prior Art

The following three systems exist mainly for the imaging method for optical disks used actually.

(1) Screen printing method (2) Offset printing method (3) Inkjet printer method

There are various kinds of optical disk, such as CD, CD-ROM, VCD, CD-R, CD-RW, DVD, DVD-R, DVD-RW, DVD-RAM, DVR or others, and all of the aforementioned media require the label printing.

Actually, the most used printing method is (1) screen printing. The reason is that, in case of printing letters or others, the definition is better than the other methods and the printing method is relatively simple. However, this method is not appropriate for graphic (color) printing.

The next most used method is (2) offset printing. This method is excellent in the graphic (color) printing which is not satisfactory in (1) screen printing, and used often for VCD and DVD.

(3) Inkjet printer method is used mainly for imaging on optical disks of small quantity. The reason is that this method is more advantageous than (1) and (2) in respect of cost because a film necessary for printing and a printing plate are not required. However, as weak point of this method, it is not appropriate for mass production, because its printing speed is extremely lower than the other methods.

Actually, in optical disk production factories where a quantity of disks should be produced at a low cost, (1) screen printing and (2) offset printing are used for label printing, because of the aforementioned reasons. However, in case of these printing methods, said film and plate are essential. In addition, each time the type (label) is modified, quantities of dummy disks (to be rejected) are required for register (positioning) and color tone matching.

As most optical disks are produced by the large item small volume production, a novel imaging method allowing to solve the aforementioned problems is desired.

In addition, it is required to colorize the label printing on the optical disk and, moreover, some designs require the combination of color images and the ground white printing. Consequently, the novel imaging method should be a one that resolves all of the aforementioned problems.

SUMMARY OF THE INVENTION

In view of problems mentioned above, the present invention has a first object of providing an imaging method on optical disks by inkjet, capable of performing the imaging efficiently on optical disks by improving the problem of low processing speed during the imaging by inkjet and appropriate for the large item small volume production.

A second object of the present invention is to provide an imaging method on optical disks by inkjet, appropriate for coloring the label printing design and, moreover, facilitating the combination of color images and ground white printing.

The other objects as well as new features of the present invention are described in embodiments mentioned below.

According to the present invention, the imaging method on optical disks by inkjet comprises a white ground printing step for printing a white ground on an optical disk, and a drawing step for imaging respectively by an inkjet printer on a plurality of optical disks arranged in a line after the white ground printing step, in the drawing step, a printer head of the inkjet printer to be scanned in the linear arrangement direction of the disks and all of the linearly arranged disks to be contained in a scanning range of the head at a single time.

BRIEF DESCRIPTION OF THE DRAWING

The above described object and other objects as well as new features of the present invention will now be clarified with reference to the following description and drawing. Embodiments of the present invention are exemplified in these descriptions and drawing but it is apparent that various modifications can be made within the scope of the claims.

DETAILED DESCRIPTION OF THE PREFERRED EMBODIMENT

Figure 1:
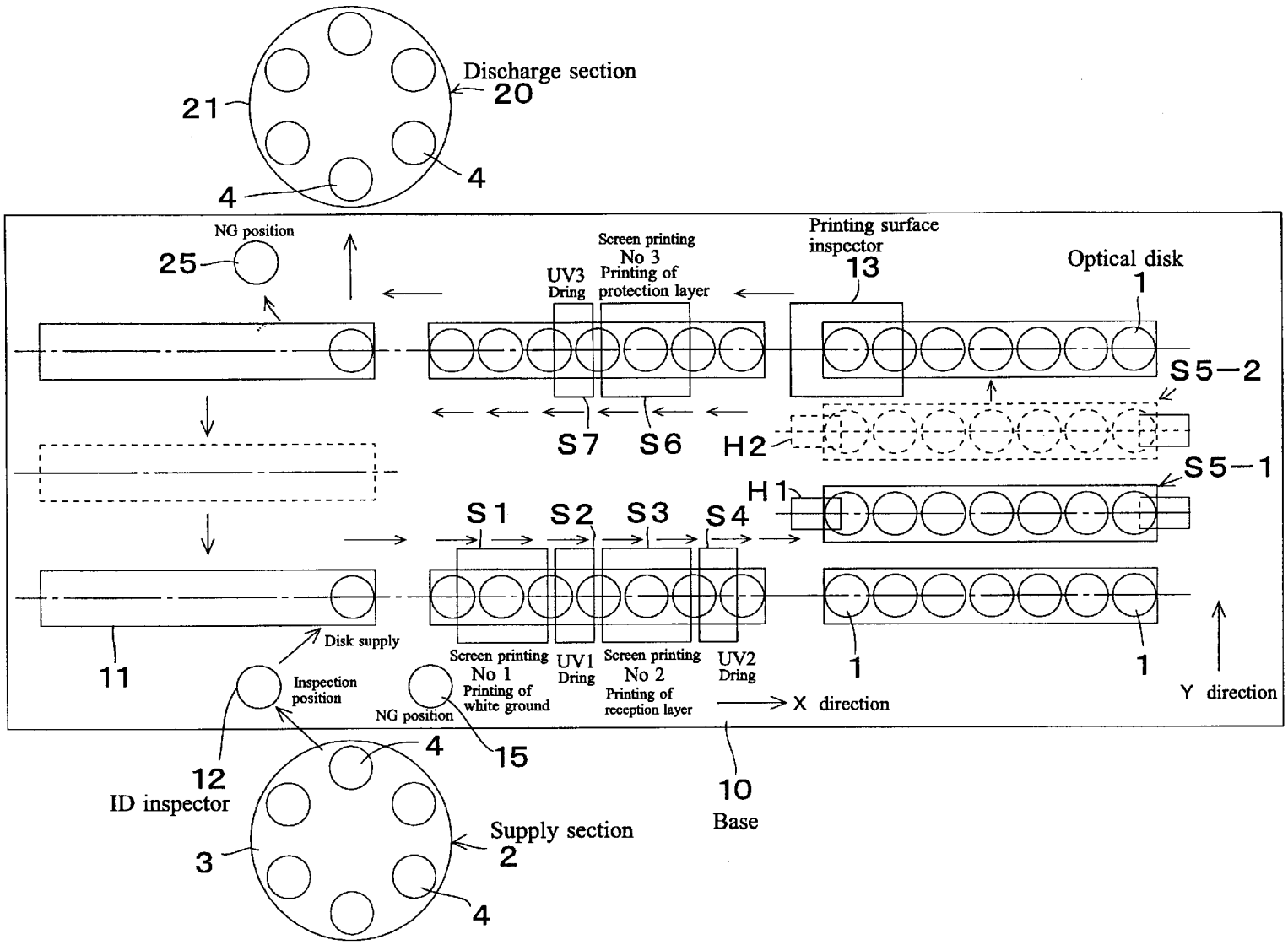
FIG. 1 is an illustrative drawing showing an embodiment of the imaging method on optical disks by inkjet according to the present invention.

FIG. 1 shows an embodiment of the imaging method on optical disk by inkjet according to the present invention. In this drawing, 1 is an optical disk and 2 is a supply section keeping a number of optical disks, and this supply section 2 is provided with a stack table (turn table) 3 turning intermittently with an equal angular interval, and the stack table 3 can be laden with a plurality of spindles 4 staking a plurality of optical disks 1.

A plurality of disk transport pallets 11 laded with a plurality of optical disks 1 in a linear arrangement are installed on a base 10 of an equipment body in a linearly movable manner (movable along paths in X direction and Y direction). Respective pallet 11 keeps the laden optical disk 1 fixed by vacuum suction. In addition, an ID inspector 12 is installed on the base 10, the ID inspector 12 inspects the ID (mark or bar code) of an optical disk 1 transferred from the supply section 2 to the disk supply position of the pallet 11.

A white ground printing station S1, a first UV station S2, a reception layer printing station S3 and a second UV station S4 are disposed respectively in a first displacement path where the disk transport palette 11 moves in the longitudinal direction thereof (optical disk linear arrangement direction; X direction). In this first displacement path, the pallet 11 moves by one arrangement pitch of the disk 1. In the white ground printing station S11, a white ultraviolet ray curing ink (paste form paint) necessary for reproducing a graphic (color) design is printed or applied by a screen printer on an optical disk 1 (white ground printing step execution; screen printing No. 1). In the reception layer printing station S3, an ultraviolet ray curing ink (paste form paint) serving as reception layer is printed or applied on the optical disk 1 by a screen printer, said ultraviolet ray curing ink serving as reception layer allowing an ink for inkjet of an extremely low viscosity to be printed (landing) on the optical disk 1 (reception layer printing step execution; screen printing No. 2). In the first and second UV stations S2 and S4, the white ground and the reception layer are dried and hardened by irradiating with ultraviolet rays from an ultraviolet dryer (UV1, UV2).

The pallet 11 having passed through the first displacement path moves to a second displacement path, and moves here in a direction orthogonal to the longitudinal direction of the pallet 11 (direction orthogonal to the optical disk linear arrangement direction; Y direction). There is an inkjet printer station S5-1 in the second displacement path, and a mechanism is provided for scanning a printer head (inkjet nozzle) H1 of a first inkjet printer in the linear arrangement direction (X direction) facing to the linearly arranged optical disks 1 on the pallet 11, in a way to contain all of the linearly arranged optical disks (7 disks in the shown example) of one line in each scan (a scanning range of the head at a single time). This inkjet printer station S5-1 is composed to send the printer head H1 of first inkjet printer exactly by a predetermined pitch in the Y direction each time after each scan of the head H1 in the X direction. Consequently, the inkjet printer can perform the drawing step rapidly, by forming a desired color image through a rapid reciprocal movement of the printer head H1 on the arranged all of optical disks on the pallet 11.

The pallet 11 having passed through the inkjet printer station S5-1 and through the second displacement path moves to a third displacement path, and here, moves in the longitudinal direction (optical disk 1 linear arrangement direction; −X direction). In this third displacement path, first a printing surface inspector 13 is installed in correspondence to the optical disks 1 on the pallet 11, and thereafter, a protection layer printing station S6 and a third UV station S7 are installed respectively. In the protection layer printing station S6, an ultraviolet curing ink (paste form ink) serving as protection layer is printed or applied on the optical disk 1 by a screen printer, said ultraviolet curing ink serving as protection layer compensating adhesion, light resistance, and water resistance of the ink for inkjet deposited on the optical disk by the inkjet printer (protection layer printing step execution; screen printing No. 3). In the third UV station S7, the protection layer is dried and hardened by irradiating with ultraviolet rays from an ultraviolet dryer (UV3). Then, a discharge section 20 for receiving the printed optical disk 1 from the discharge position of the pallet 11 is provided with a stack table 21 (turn table) turning intermittently with an equal angular interval. The stack table 21 is laden with a plurality of spindles 4 that can receive a plurality of optical disks 1.

Next, the imaging procedures on the optical disks shall be described.

The stack table 3 provided on the supply section 2 is laden with a spindle 4 carrying stacked non processed optical disks 1, and the optical disks 1 are transferred one by one form the spindle 4 to the ID (mark or bar code) inspection position. The optical disk 1 judged to be normal by the ID inspector 12 installed in this inspection position is transferred to the disk supply position of the disk transport pallet 11. The disk judged to be inferior by the ID inspection is discharged at the NG position 15 on the base 10.

The pallet 11 moves in the pallet longitudinal direction along the first displacement path, and is sent intermittently by one pitch of the arrangement interval of the optical disk 1. Then, in the white ground printing station S1, the screen printer prints or applies a white ultraviolet ray curing ink necessary for reproducing a graphic (color) design on the optical disk 1 (white ground printing step execution; screen printing No. 1), and in the first UV station S2, the white ground is dried and hardened by irradiating with ultraviolet rays from the ultraviolet dryer (UV1). Then, in the reception layer printing station S3, the screen printer prints or applies on the optical disk 1 ultraviolet ray curing ink serving as reception layer allowing an ink for inkjet of an extremely low viscosity to be clearly printed (landing) on the optical disk 1 (reception layer printing step execution; screen printing No. 2) and, in the second UV station S4, the reception layer is dried and hardened by irradiating with ultraviolet rays from the ultraviolet dryer (UV2).

Upon termination of these steps, the pallet 11 moves to the second displacement path, and moves in a direction orthogonal to the longitudinal direction of the pallet 11 and in the inkjet printer station S5-1, the printing by the first inkjet printer is performed at one time on the optical disk reception layer for all of seven optical disks arranged in a line by scanning the printer head (inkjet nozzle) H1 of the first inkjet printer facing to the linearly arranged optical disks 1 on the pallet 11. In short, the identical imaging on all optical disks 1 in one line are performed by the inkjet printer at one time, by repeating the operation of said printer head H1 scanned in the linear arrangement direction (X direction) from the first disk to the last disk each time before the pallet 11 is sent exactly by a predetermined pitch in the Y direction (drawing step execution). Here, in case of improving the print quality, the sending pitch of the pallet 11 may be set finer, and in case where it is unnecessary to improve the print quality, the sending pitch may be set larger. The production quantity varies according to the pitch scale. Though the case of forming the identical image on optical disks in one line, it is also possible to form images different each other.

In case of increasing the production capacity by two, it can be solved by adding another inkjet printer. In short, a second inkjet printer may be installed on the inkjet printer station S5-2 as shown by dot line in FIG. 1, and the optical disks on the pallet 11 in the other line than the printer head H1 may be printed in parallel by the printer head H2 of the second inkjet printer. In case of triple production capacity, still another inkjet printer shall be added.

The pallet 11 loaded with the optical disks 1 having finished the processing by the inkjet printer moves to the third displacement path, and at the print surface inspection position disposed in this third displacement path, the printing surface inspector 13 inspects the print quality of the optical disk transported by the pallet 11. Thereafter, the protection layer printing station S6 prints and applies on the optical disk 1, by the screen printer, an ultraviolet curing ink serving as protection layer compensating adhesion, light resistance, and water resistance of the ink for inkjet deposited on the optical disk by the inkjet printer (protection layer printing step execution; screen printing No. 3) and the third UV station S7 dries and hardens the protection layer by irradiating with ultraviolet rays from an ultraviolet dryer (UV3).

Then, when finished optical disks 1 are transferred to the discharge section 20 one by one from the pallet 11, those disks judged inferior by the print face inspection are discharged in the NG position on the base 10. Only those optical disks 1 judged normal by the print face inspection are discharged are transferred to a predetermined spindle 4 on the stack table 21.

The vacant pallet 11 moves to a fourth displacement path, moves in a direction orthogonal to the pallet longitudinal direction (−Y direction), returns to the disk supply position, and thereafter, circulates in the order of first displacement path, second displacement path, third displacement path and fourth displacement path. In all of the aforementioned steps, the optical disk 1 is transported as vacuum sucked on the pallet 11.

This embodiment is able to have advantageous effects as follows.

(1) The imaging by the inkjet printer makes unnecessary a film or a print plate required for screen printing or offset printing, and reducing printing cost even in the large item small volume production. In addition, the film and the print plate are unnecessary, and there in no problem of a quantity of rejected dummy disks for register (positioning) and color tone matching each time the item (label) is changed. Moreover, a high quality color printing becomes possible by adopting a model using 6 color inks (yellow, magenta, cyan, black, light magenta, light cyan) as inkjet printer.

(2) As the image is formed at one time on a number of optical disks 1 by a rapid inkjet printer, the printing speed can be increased compared to the case where the whole area of an optical disk is printed before proceeding to the printing of the next optical disk. In short, a single scanning range of the printer head of inkjet printer is composed to contain all of linearly arranged optical disks for executing the printer head scanning efficiently and improving the production efficiency. Thereby, it becomes a production machine that can be used in the optical disk production factory.

(3) The production capacity can further be increased, by executing the inkjet drawing step on different linear arrangements of optical disk 1 by a plurality of inkjet printers.

(4) The formation steps of white ground layer and ink reception layer, necessary for imaging by inkjet is integrated inline and the color imaging by the inkjet printer is executed all the way keeping the optical disk 1 sucked by the pallet 11 used for these steps, permitting to regulate exactly the positional relation between the optical disk position and a color image, and execute securely the registration of the color image and the ground white print.

(5) As the inkjet printer can immediately output (print) digitally processed data from a computer, images different each other can be formed rapidly, which is impossible for the screen printer or offset printer. In short, it comes to be concluded that the image to be formed at one time on a plurality of optical disks 1 may be identical, or different for respective disks. In addition, as mentioned above, dummy disks become unnecessary.

(6) Inkjet allows to print non-contact, and the inkjet method is more advantageous than the other methods for CD-R, extremely vulnerable to the pressure, DVD, CDV or other disks whose performance is largely affected by warping.

Though the white ground printing step and the reception layer printing step are executed independently in the aforementioned embodiment, a white ground serving also as reception layer for inkjet may be printed on the optical disk in the white ground printing step, and the drawing step by the inkjet printer may be executed omitting the ultraviolet ray irradiation and drying immediately after the same. In short, there are cases where half dry white ground may even be used as reception layer.

The composition of the aforementioned embodiment corresponds to a case where the optical disk color printing is performed by an inkjet printer using inks of the prior art; however, if an ultraviolet ray curing ink that can be used in the inkjet printer becomes practical, the printing step of reception layer and protection layer can be made unnecessary, making the screen printer for printing the reception layer and protection layer useless and, thereby, making the equipment small and cheaper.

Though the aforementioned embodiment illustrates an imaging method using an inkjet printer which is offline in respect to the manufacturing line of optical disk itself, it can also be applied satisfactorily to an imaging equipment using an inline inkjet printer, because a direct connection with the previous step can be realized by omitting the supply section side stack table. By making it inline, the optical disk manufacturing process can largely be rationalized and, moreover, the production control becomes easier to perform.

As described hereinabove, the imaging method on optical disk by inkjet according to the present invention allows to draw on optical disks at a low cost even when the quantity is relatively small and, moreover, reduce the printing time by the ink jet.

What is claimed is:

1. A method of forming an image on optical disks by inkjet printing comprising, sequentially:

printing a white ground on an optical disk; and printing an image, using an inkjet printer, on a plurality of optical disks arranged along a linear direction, by sequentially printing a plurality of lines on the plurality of optical disks with an inkjet printer head of the inkjet printer, each line being printed across all of the plurality of optical disks before an adjacent line is printed on any of the plurality of optical disks, wherein all of the disks are arranged within a scanning range of the printer head of the inkjet printer.

2. The method according to claim 1, including moving the optical disks in a direction orthogonal to the linear direction of the optical disks between printing of adjacent lines.

3. The method according to claim 2, wherein the optical disks are arranged along a plurality of substantially parallel linear directions, and respective inkjet printers respectively print images on the disks along each of the linear directions.

4. The method according to claim 2, including transporting the optical disks arranged along a linear direction on a pallet while held in place by vacuum.

5. The method according to claim 1, wherein the optical disks are arranged along a plurality of substantially parallel linear directions, and respective inkjet printers respectively print images on the disks along each of the linear directions.

6. The method according to claim 5, including transporting the optical disks arranged along linear directions on a pallet while held in place by vacuum.

7. The method according to claim 1, including transporting the optical disks arranged along a linear direction on a pallet while held in place by vacuum.

8. A method of forming an image on optical disks by inkjet printing comprising, sequentially:

printing a white ground on an optical disk;

printing a reception layer for inkjet printing on the white ground;

drawing an image, using an inkjet printer, on a plurality of optical disks arranged along a linear direction; and printing a protection layer on the optical disk, wherein all of the disks are arranged within a scanning range of a printer head of the inkjet printer and the printer head of the inkjet printer is scanned in the linear direction a single time.

9.The method according to claim 8, including, moving the optical disks in a direction orthogonal to the linear direction of the optical disks.

10. The method according to claim 8, wherein the optical disks are arranged along a plurality of linear directions, and respective inkjet printers respectively draw on the disks along each linear direction.

11. The method according to claim 8, including transporting the optical disks arranged along a linear direction on a pallet while held in place by vacuum.

* * * * *